US007798595B2

(12) United States Patent
Hatsui et al.

(10) Patent No.: US 7,798,595 B2
(45) Date of Patent: Sep. 21, 2010

(54) SUBSTRATE FOR INK JET PRINTING HEAD, INK JET PRINTING HEAD, INK JET PRINTING APPARATUS, AND METHOD OF BLOWING FUSE ELEMENT OF INK JET PRINTING HEAD

(75) Inventors: Takuya Hatsui, Tokyo (JP); Teruo Ozaki, Yokohama (JP); Ichiro Saito, Yokohama (JP); Sakai Yokoyama, Kawasaki (JP); Kazuaki Shibata, Kawasaki (JP); Takahiro Matsui, Koganei (JP)

(73) Assignee: Canon Kabushiki Kaisha, Tokyo (JP)

( * ) Notice: Subject to any disclaimer, the term of this patent is extended or adjusted under 35 U.S.C. 154(b) by 148 days.

(21) Appl. No.: 12/244,410

(22) Filed: Oct. 2, 2008

(65) Prior Publication Data

US 2009/0040264 A1 Feb. 12, 2009

Related U.S. Application Data

(62) Division of application No. 11/480,937, filed on Jul. 6, 2006, now Pat. No. 7,472,975.

(30) Foreign Application Priority Data

Jul. 8, 2005 (JP) ..... 2005-200160

(51) Int. Cl.
*B41J 2/01* (2006.01)

(52) U.S. Cl. ..... 347/19; 347/5; 347/61

(58) Field of Classification Search ..... 347/5, 347/9, 19, 59, 61

See application file for complete search history.

(56) References Cited

U.S. PATENT DOCUMENTS 5,363,134 A 11/1994 Barbehenn et al.
5,479,197 A 12/1995 Fujikawa et al.
5,504,507 A 4/1996 Watrobski et al.
5,580,468 A 12/1996 Fujikawa et al.
5,956,052 A 9/1999 Udagawa et al.
6,130,692 A 10/2000 Mochizuki et al.
6,293,655 B1 9/2001 Imanaka et al.
6,402,302 B1 6/2002 Ozaki et al.
6,439,680 B1 8/2002 Mochizuki et al.
6,513,911 B1 2/2003 Ozaki et al.
6,578,951 B2 6/2003 Ozaki et al.
6,688,729 B1 2/2004 Imanaka et al.

(Continued)

FOREIGN PATENT DOCUMENTS

JP 3-126560 5/1991

*Primary Examiner*—Lam S Nguyen
(74) *Attorney, Agent, or Firm*—Fitzpatrick, Cella, Harper & Scinto

(57) ABSTRACT

A fuse element can be reliably blown and data that corresponds to whether or not the fuse element has been blown can be stored with high reliability. A resistor element is provided in a circuit through which an electric current flows to blow the fuse element in the ink jet printing head. The resistor element adjusts the electric current so that, in the process of blowing the fuse element, the current continues to flow for a predetermined duration even after a maximum current has passed through the fuse element. The predetermined duration is longer than a period from a time point when the electric current rises to a time point when the electric current reaches the maximum current.

9 Claims, 13 Drawing Sheets

U.S. PATENT DOCUMENTS 6,773,096 B2 8/2004 Mochizuki et al.
6,945,633 B2 9/2005 Imanaka et al.
7,108,345 B2 9/2006 Mochizuki et al.
7,216,960 B2 5/2007 Imanaka et al.
2005/0140707 A1 6/2005 Imanaka et al.
2005/0259123 A1 11/2005 Rice et al. ..... 347/5
2007/0091131 A1 4/2007 Hatsui et al.
2007/0188559 A1 8/2007 Imanaka et al.

SUBSTRATE FOR INK JET PRINTING HEAD, INK JET PRINTING HEAD, INK JET PRINTING APPARATUS, AND METHOD OF BLOWING FUSE ELEMENT OF INK JET PRINTING HEAD

This is application is a division of U.S. patent application Ser. No. 11/480,937, filed Jul. 6, 2006, issued as U.S. Pat. No. 7,472,975.

BACKGROUND OF THE INVENTION

1. Field of the Invention

The present invention relates to a substrate for an ink jet printing head with fuse element that can be blown by passing an electric current therethrough, an ink jet printing head with the substrate, an ink jet printing apparatus using the ink jet printing head, and a method of blowing the fuse element of the ink jet printing head.

2. Description of the Related Art

A variety of types of printing apparatus, such as laser printers and ink jet printers, have been in use. An ink jet printer (ink jet printing apparatus) forms an image by ejecting ink droplets from a printing head. The ink ejection method includes an electrothermal conversion method (bubble jet system) that uses electrothermal transducers (heating elements). The ink jet printing head of the electrothermal conversion type holds a liquid ink in an ink holding unit comprising a nozzle, an ink supply path and an ink reservoir. The heating element in each nozzle is energized to form a bubble in the ink and an energy of the expanding bubble expels an ink droplet from the nozzle.

In a general serial scan type ink jet printer, the printing head capable of ejecting an ink is supported on a carrier mechanism so that it can be moved in a main scanning direction. To a position facing the printing head, paper as a printing medium is successively fed in a sub scanning direction by a paper feed mechanism. As the ink ejecting printing head and the surface of the printing medium are moved relative to each other in the main and sub scanning directions, the printing head ejects ink droplets according to print data. Ejected ink droplets land on and adhere to the surface of the printing medium to form a dot matrix image.

The ink jet printing head comprises, for example, a head substrate and a nozzle member, with a base of the head substrate having an ink ejection mechanism and others formed of various layered films. The ink ejection mechanism uses heating elements in the case of an electrothermal conversion type and piezoelectric elements in the case of an electromechanical type. Generally, on the surface of the base a driver circuit for driving the ink ejection mechanism and a data input portion for supplying print data to the driver circuit are also formed of a various layered films.

In recent years it has been proposed to mount a ROM (Read Only Memory) on the head substrate so that data, such as a printing head ID (Identity) code and a drive characteristic of the ink ejection mechanism, can be readably held in the ink jet printing head. For example, Japanese Patent Application Laid-open No. 3-126560 (1991) discloses a construction in which an EEPROM (Electrically Erasable Programmable ROM) is mounted on the ink jet printing head. The ink jet printing head disclosed in Japanese Patent Application Laid-open No. 3-126560 (1991), however, has the EEPROM mounted separately from the head substrate and thus its construction is complex, deteriorating productivity and making a size and weight reduction difficult. Another disadvantage is that although the existing ROM chip is useful when print data is large, it becomes a disadvantage costwise when the print data is small.

U.S. Pat. No. 5,504,507 and U.S. Pat. No. 5,363,134 disclose a construction in which a ROM comprised of fuse elements is formed in the base of the head substrate of the ink jet printing head along with the layered films of the ink ejection mechanism. In this construction, when the layered films such as the ink ejection mechanism are formed on the base during the process of manufacturing the head substrate, the fuse elements as the ROM can also be formed at the same time. By selectively blowing the fuse elements, the ROM can hold binary data according to the presence or absence of the fuses, or whether or not the fuses have been blown. The ink jet printing head using such a head substrate does not require a ROM chip to be prepared separately from the head substrate, thus simplifying the construction capable of readably holding a variety of data, improving the productivity and realizing reductions in size and weight.

The head substrate disclosed in U.S. Pat. No. 5,504,507 and U.S. Pat. No. 5,363,134 can readably hold various data of the ink jet printer through the fuse elements and have these fuse elements formed in the base along with various layered films. For example, as shown in FIG. 10, a fuse element 410, an interlayer insulating film 104, fuse electrodes 105, and a protective film (insulating film) and others are formed in layers in a predetermined shape on the surface of the base 101. Over the surface of the protecting film (insulating film) a nozzle member 107 is formed of an organic resin.

As a method of blowing such a fuse element 410, a laser beam method which electrically opens the fuse element 410 by blowing and evaporating it with a laser beam is most effective. This method, however, is not suited for mass production because a melted material produced when the fuse element 410 is blown adheres to the printed circuit board and because the fuse element blowing process makes this method costly. Another method that blows the fuse element 410 by applying a large electric current is not costly, with little melted material adhering to the printed circuit board. So, this method is suited for mass production.

Ink contacts the head substrate of the ink jet printing head. If, for example, the ink infiltrates into a portion where a fuse element was blown, that portion and electrodes may be corroded, deteriorating reliability. For this reason, the fuse elements fabricated in the head substrate at the same time that the board is fabricated must have a structure that enables the fuse elements to be blown reliably and prevents the ink infiltration.

In the method that applies an electric current to the fuse element 410 to blow it, since the fuse element is situated at the lower part of the layered structure, as shown in FIG. 10, the fuse material melted when it is blown may fail to scatter sufficiently. If the fuse element is blown and becomes electrically open, the open circuit may be closed again by the melted fuse material that exists in a narrow space.

SUMMARY OF THE INVENTION

The present invention is directed to provide a substrate for an ink jet printing head, an ink jet printing head, an ink jet printing apparatus, and a method of blowing a fuse element of an ink jet printing head, all of which can blow a fuse element reliably and store data with high reliability according to whether the fuse element is blown or not.

In a first aspect of the present invention, there is provided a substrate for an ink jet printing head having ejection energy generation means for generating an ink ejection energy, and a fuse element capable of being blown by passing an electric current therethrough, the substrate comprising current adjusting means provided in a circuit through which the electric current flows, wherein in a process of blowing the fuse element, the current adjusting means adjusts the electric current so that the electric current continues to flow in the fuse element for a predetermined duration even after a maximum current has flowed through the fuse element, the predetermined duration is longer than a period from a time point when the electric current rises to a time point it reaches the maximum current.

In a second aspect of the present invention, there is provided an ink jet printing head including the substrate for the ink jet printing head of the first aspect of the present invention;

the ink jet printing head ejecting ink by driving the ejection energy generation means and being able to store data according to whether or not the fuse element have been blown.

In a third aspect of the present invention, there is provided an ink jet printing apparatus to print an image on a printing medium by using an ink jet printing head capable of ejecting ink, the ink jet printing apparatus comprising:

a mounting portion on which the ink jet printing head of claim 8 can be mounted; and means for reading data stored in the fuse element in the ink jet printing head.

In a fourth aspect of the present invention, there is provided an ink jet printing apparatus to print an image on a printing medium by using an ink jet printing head, the ink jet printing head capable of ejecting ink from ink ejection openings and having fuse element capable of being blown by passing an electric current therethrough; the ink jet printing apparatus comprising current adjusting means provided in a circuit through which the electric current flows; wherein in a process of blowing the fuse element, the current adjusting means adjusts the electric current so that the electric current continues to flow in the fuse element for a predetermined duration even after a maximum current has flowed through the fuse element, the predetermined duration is longer than a period from a time point when the electric current rises to a time point it reaches the maximum current.

In a fifth aspect of the present invention, there is provided a method of blowing a fuse element by applying an electric current to which, the fuse element being provided in an ink jet printing head capable of ejecting ink, the method comprising the step of:

in a process of blowing the fuse element, continuing to flow the electric current for a predetermined duration even after a maximum current has flowed through the fuse element, the predetermined duration is longer than a period from a time point when the electric current rises to a time point it reaches the maximum current.

With this invention, in the process of blowing a fuse element in an ink jet printing head by applying an electric current to the fuse element, the current continues to be applied for a predetermined period immediately after a maximum current has passed through the fuse element. The predetermined period is longer than a period from a time point when the blow current flowing in the fuse element rises to a time point it reaches its peak (maximum current). This prolongs the heating time and assures sufficient heating of the fuse element to form a large enough space around it in which to allow the material of the fuse element to fully scatter. This ensures reliable blowing of the fuse element, making it possible to store data with high reliability according to whether fuse element is blown or not.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Referring to the accompanying drawings, preferred embodiments of this invention will be described.

First, an example construction of an ink jet printing apparatus that can apply the present invention will be explained. The ink jet printing apparatus of this embodiment is of a serial scan type as shown in FIG. 8, and its control system is configured as shown in FIG. 9.

Figure 8:
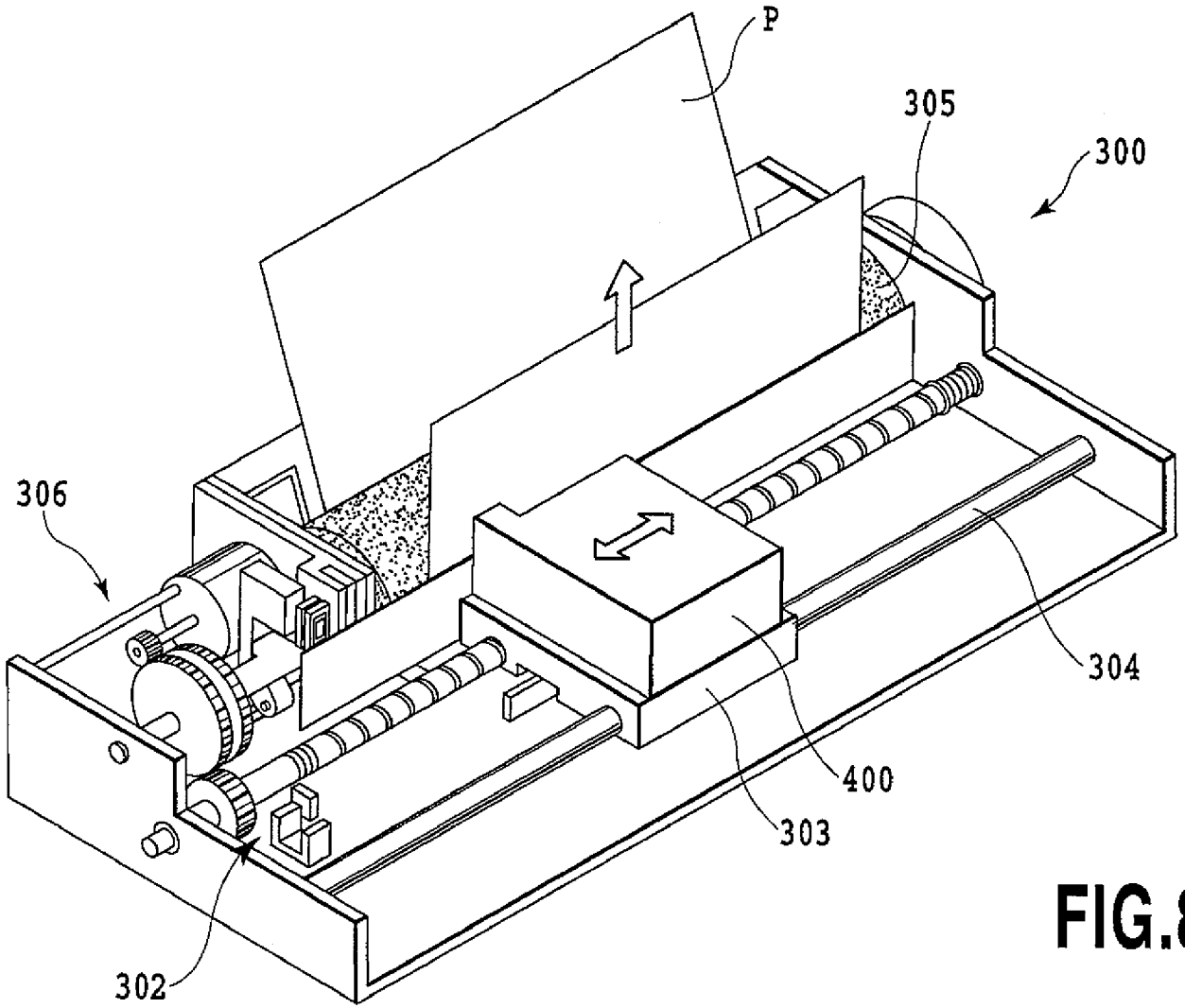
FIG. 8 is a perspective view showing an essential part of an ink jet printing apparatus that can be applied with the present invention.

The ink jet printing apparatus 300 of this example, as shown in FIG. 8, prints an image by using an ink jet printing head 400. The printing head 400 incorporates a base 401 (see FIG. 1) which has formed in its surface heater elements 430, wires and fuse elements 410. The base 401 is also formed with electrode pads 420 for electrically connecting a head substrate including the base 401 with external terminals.

The printing head 400 is removably mounted on a carriage 303 of a head moving mechanism 302. The carriage 303 is supported on a guide shaft 304 so that it can be moved in a main scanning direction indicated by an arrow X. The carriage 303 is reciprocally moved in the main scanning direction by the head moving mechanism 302. The printing head 400 is moved in the main scanning direction together with the carriage 303. At a position facing the printing head 400 supported as described above is arranged a platen roller 305 that holds and transports paper P as a printing medium. The platen roller 305 makes up a printing medium transport mechanism 306 that successively transports the printing medium P in a sub scanning direction indicated by an arrow Y.

Figure 9:
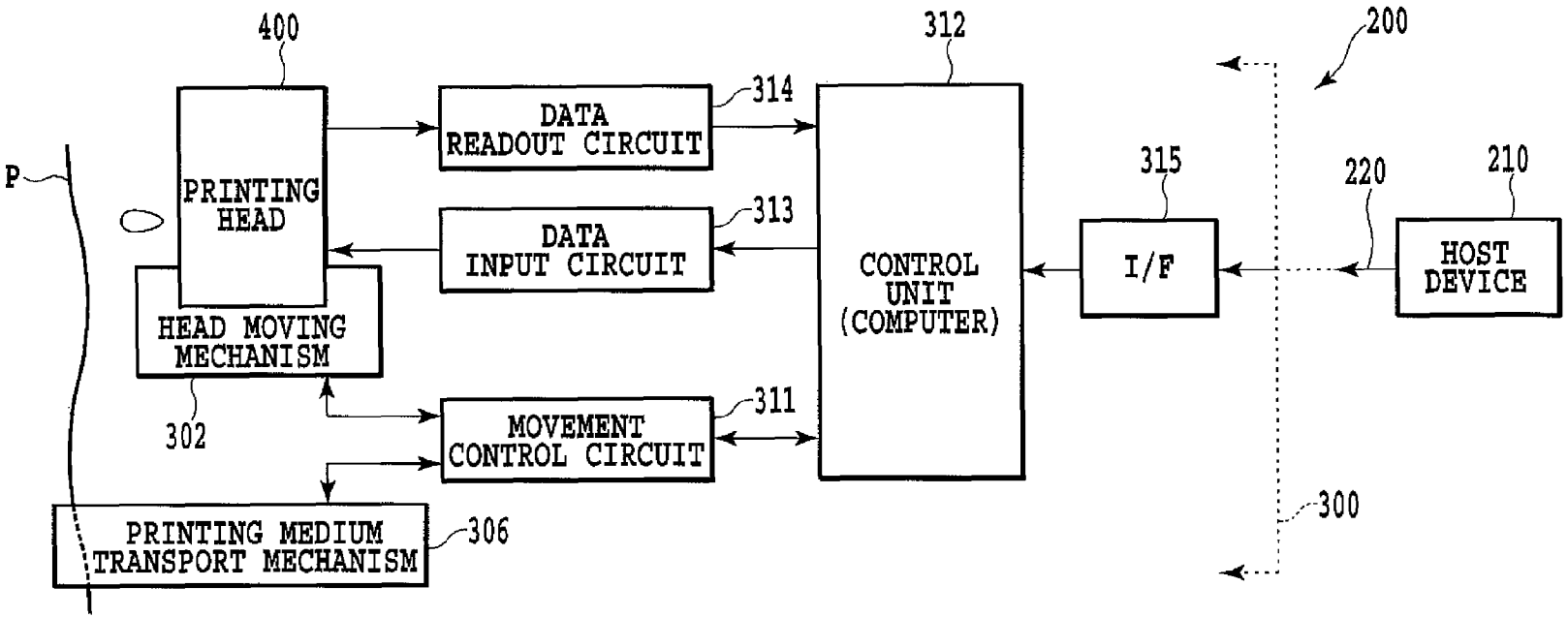
FIG. 9 is a block diagram of a control system for the ink jet printing apparatus of FIG. 8.
Figure 10:
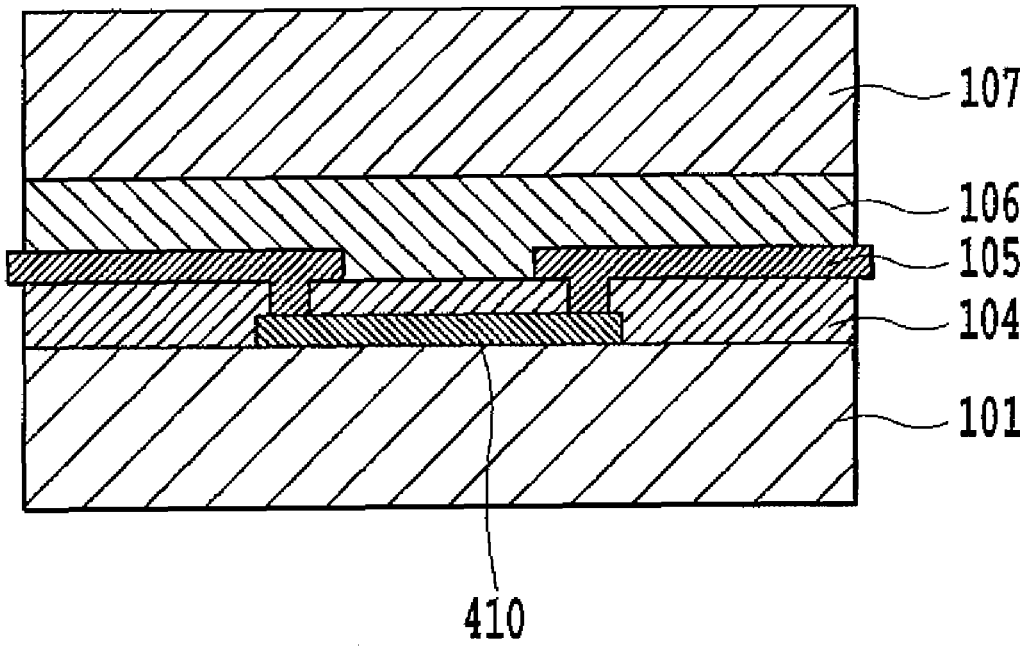
FIG. 10 is a cross-sectional view of a fuse element portion in a substrate of a conventional printing head.

The head moving mechanism 302 and the printing medium transport mechanism 306, as shown in FIG. 9, are connected to a movement control circuit 311, which in turn is connected to a control unit 312 in the form of a microcomputer. The control unit 312 integrally controls the head moving mechanism 302 and the printing medium transport mechanism 306 to move the printing head 400 relative to the printing medium P. The control unit 312 is connected with a data input circuit 313 as a data input means, a data readout circuit 314 as a data reading means, and a communication interface 315. The communication interface 315 is connected to a host device 210 in the form of a host computer through a communication cable 220.

The data input circuit 313 is connected to a printing logic circuit (not shown) in the printing head 400 through a connector of the carriage 303 to supply print data to the printing logic circuit. The data readout circuit 314 is connected to a fuse logic circuit (not shown) in the printing head 400 through a connector in the carriage 303 and reads stored data of the fuse elements 410 from the fuse logic circuit.

The control unit 312 in the form of a microcomputer also controls these circuits 311, 313, 314 integrally.

For example, the control unit 312 supplies to the data input circuit 313 print data input from the host device 210 into the communication I/F 315. It also outputs from the communication I/F 315 to the host device 210 the stored data read out by the data readout circuit 314 from the printing head 400.

The printing apparatus 300 of this example also has an ink tank (not shown) as an ink supply means removably mounted on the carriage 303. The ink tank is piped to an ink holding unit of the printing head 400 through a socket member (not shown) of the carriage 303. The ink tank is filled with ink, which is supplied to the printing head 400.

In FIG. 9, denoted 200 is an image processing system which comprises a host device (host computer) 210 as a central control unit and a printing apparatus 300. The printing apparatus 300 and the host device 210 are connected through a communication cable 220. The image processing system 200 operates the printing apparatus 300 according to print data supplied from the host device 210. At this time, the integral control by the control unit 312 causes the head moving mechanism 302 to move the printing head 400 in the main scanning direction and at the same time the printing medium transport mechanism 306 to transport the printing medium P in the sub scanning direction. In synchronism with these operations, the data input circuit 313 inputs the print data into the printing head 400.

The printing head 400 holds ink supplied continuously from the ink tank and the print logic circuit in the printing head 400 selectively drives some of a large number of heater elements 430 according to the print data. This selective energization of the heater elements 430 generates bubbles in ink which in turn expel ink droplets from the associated ejection openings or nozzles. When the ejected ink droplets land on and adhere to the surface of the printing medium P, a dot matrix image is formed.

Figure 1:
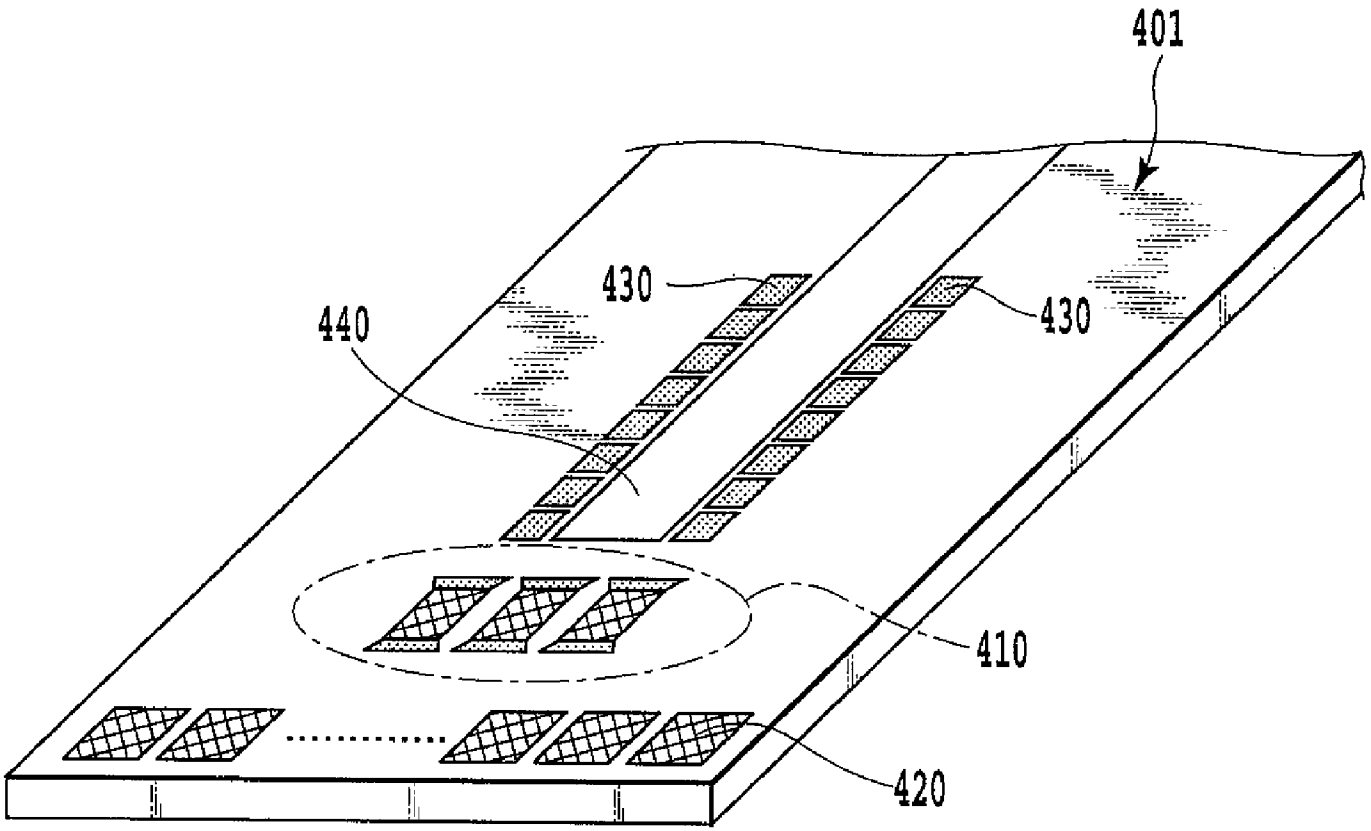
FIG. 1 is a perspective view of a substrate of a printing head in one embodiment of this invention.

In the printing head 400 of this example incorporates a base 401, such as shown in FIG. 1. On the base 401 are formed heater elements 430, fuse elements 410, electrode pads 420 and wires. The heater elements 430 generate a thermal energy as an ink ejection energy to heat the ink and generate a bubble in the ink to expel an ink droplet from the nozzle not shown. The electrode pads 420 form electrodes for electrically connecting wires formed on the base 401 to external terminals and receive a drive signal for the heater elements 430. The plurality of fuse elements 410 can be blown by an electric current and which are formed as described later. By selectively blowing individual fuse elements, various data can be stored. Denoted 440 is an ink supply port that is formed at a central part of the base 401 and around which the heater elements 430 are arranged.

In the upper layer of the base 401 constructed as described above, flow paths for ejecting ink are formed of an organic resin layer. A lower part of the base 401 is connected to an ink supply unit that supplies ink from the ink tank not shown to the ink supply port 440. In this way, the ink jet printing head is completed.

The printing head 400 has the fuse elements 410, and the image processing system 200 (see FIG. 9) can store a variety of data in the fuse elements 410, for example, before shipping after the manufacture of the printing head 400 is completed. The data to be stored may, for example, be data on printing head ID code and operation characteristics of the heater elements 430. The printing head 400 shipped with these data stored is now mounted on the carriage 303 for operation. At this time, the printing apparatus 300 can read the stored data of the fuse elements 410 in the printing head 400 by the data readout circuit 314.

Therefore, the printing apparatus 300 can adjust a drive power to be supplied to the heater elements 430 according to the data on the operation characteristics of the heater elements 430 read out from the fuse elements 410 in the printing head 400. The printing apparatus 300 can also inform the ID code of the printing head 400 to the host device 210.

As described above, the fuse elements 410 can be made to store data on the ID code of the printing head 400 or data on operation characteristics of the heater elements 430. The data on the operation characteristics of the heater elements 430 may, for example, concern electric characteristics such as resistance of the heater elements 403 that enable the printing head 400 to be operated under an optimal condition. These data is stored in the fuse elements 410 at time of shipping of the printing head 400. Then, when the printing head 400 is mounted on the printing apparatus 300 for operation, the printing apparatus 300 reads the data stored in the fuse elements 410 so as to be able to drive the printing head 400 under the optimal condition.

Next, the method of forming the fuse elements 410 in the printing head 400 will be explained.

Before the fuse elements 410 are formed, a base built with semiconductor devices, such as drive elements and logic circuits, by using a semiconductor fabrication process is prepared. The fuse elements may be fabricated in the following manner by using polysilicon of gates used when forming semiconductor devices.

Figure 2:
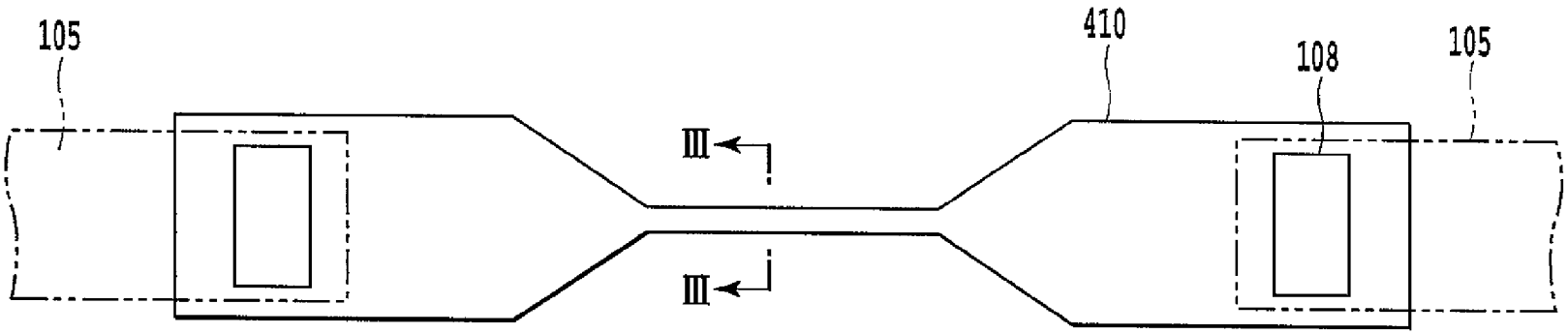
FIG. 2 is an enlarged plan view of a fuse element of FIG. 1.
Figure 3:
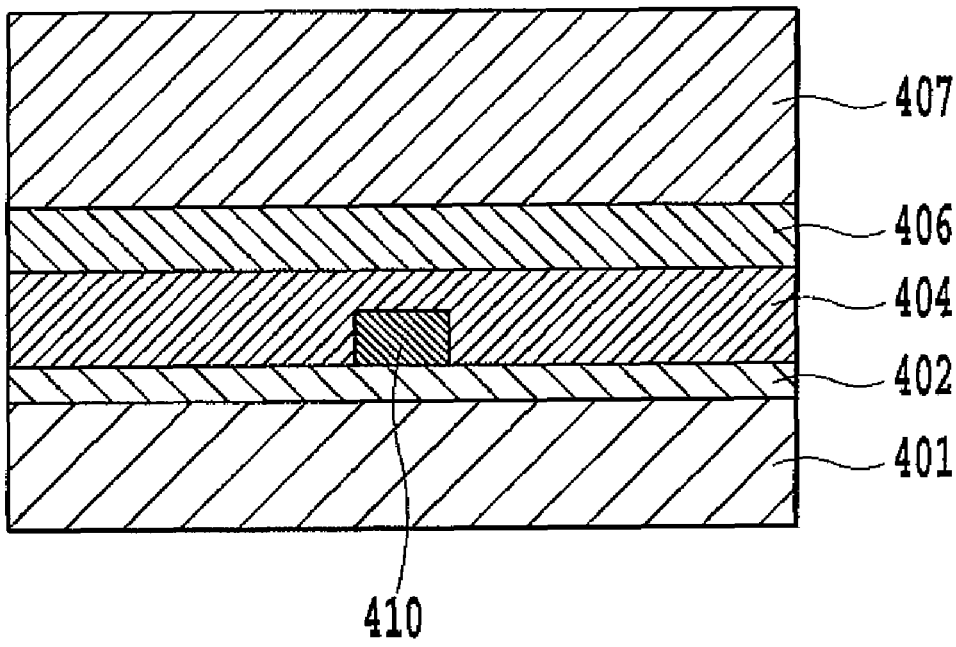
FIG. 3 is a cross-sectional view taken along the line III-III of FIG. 2.

FIG. 2 is an enlarged plan view of one fuse element 410 of FIG. 1, which has an ink ejection path formed of an organic resin layer on the upper layer of the fuse element 410. FIG. 3 is a cross-sectional view taken along the line III-III. In FIG. 2, the fuse element 410 formed of polysilicon is narrow at its central portion. The central portion of the fuse element is formed narrow, about 10 μm in length and about 1.5 μm in width, so that it can easily be blown. The ends of the fuse element 410 are connected to aluminum electrodes 105. Denoted 108 is a through-hole to connect the fuse element 410 and the aluminum electrode 105.

In FIG. 3, the fuse element 410 is formed of a polysilicon layer about 4000 Å thick and laminated over a thermal oxide film 402 on the surface of the base 401. Over the fuse element 410 a SiO film 404 containing phosphorus is formed by a plasma CVD method to a thickness of about 8000 Å as an interlayer insulating film. The SiO film 404 containing phosphorus has a lower melting point than that of the polysilicon fuse element 410 and is therefore easily gasified by the heat produced by the blowing of the fuse element to form a hollow space. The thickness of the SiO film 404 should preferably be set in a range of between 0.5 μm and 1 μm so as to prevent an overlying layer from being cracked and destroyed.

Next, a SiO film 406 not containing phosphorus is deposited by the plasma CVD method to a thickness of 6000 Å in order to control the hollow space that is formed in the SiO film 404 by the fuse element 410 as it is blown. The film 406 has a higher melting point than that of the SiO film 404 containing phosphorus and is not easily melted by heat so that it minimizes the expansion of the hollow space in the SiO layer 404 and thereby controls it to the predetermined size. Although its melting speed is slow, a part of the film 406 is melted by heat to form a hole, from which ejections are released to prevent a possible crack that would otherwise be developed by an inner pressure if the expansion of the hollow space was completely suppressed. Therefore, it is desired that the thickness of the SiO film 406 not doped with phosphorus be set in a range of between 0.3 μm and 0.8 μm to minimize the expansion of the hollow space and still allow a hole to be partly formed.

Next, after these fuse elements 410 and associated portions are formed, a material for the heater element 430 (see FIG. 1), Ta SiN, is sputtered to a thickness of about 500 Å, which is immediately followed by an aluminum layer as a wire layer being formed to about 5000 Å. These layers are patterned by the photolithography to a predetermined geometry and dry-etched using a $BCl_3$ gas to form the aluminum layer and the TaSiN layer into the predetermined shape at the same time. Further, the portions associated with the heater elements 430 are patterned by the photolithography to a predetermined configuration and wet-etched using mainly a phosphoric acid.

Over these layers a SiN film as a protective film is deposited by the plasma CVD method to a thickness of about 3000 Å. Further, a Ta film as a cavitation resistant film is sputtered to a thickness of about 2000 Å. Then, these Ta film and SiN film are dry-etched by the photolithography into a predetermined configuration. In this process, the Ta film and SiN film over the fuse elements 430 are removed.

Next, ink paths for ejecting ink are formed three-dimensionally of an organic resin layer 407 by using the photolithography. Now, a substrate (head substrate) for the printing head 400 is completed.

Figure 5:
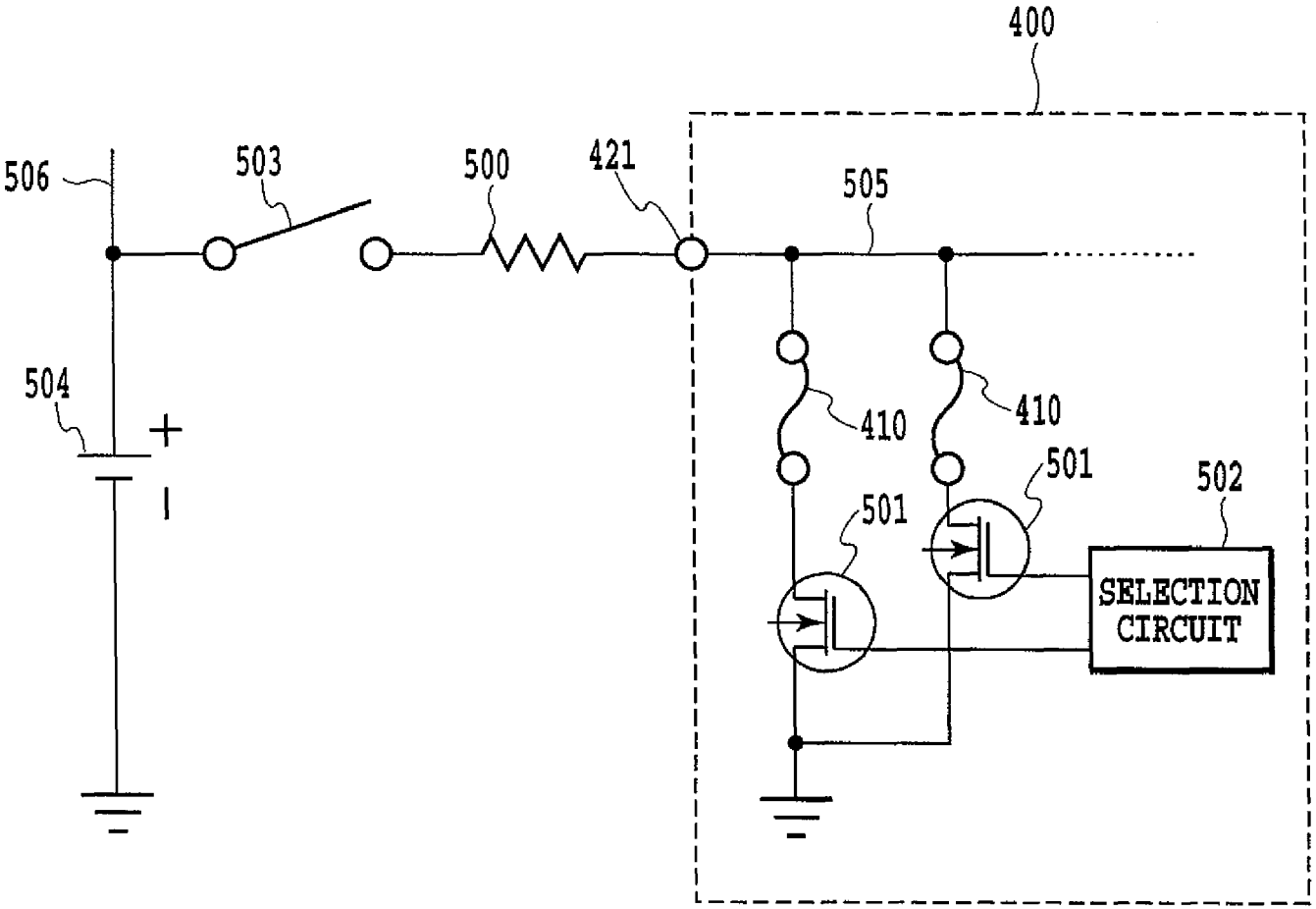
FIG. 5 illustrates a circuit for blowing fuse elements in the embodiment of this invention.

FIG. 5 shows a drive circuit connected to the fuse elements 410.

The fuse elements 410 are connected to drive elements 501 for melting the fuse elements and reading information. In this example, the plurality of fuse elements 410 are individually connected with the drive element 501 which is selectively driven by a selection circuit 502. The selection circuit 502 includes signal lines, a decoder that generates a time-division selection signal (BLE), a latch circuit (LT) for these and other signals, a shift register (S/R), and an input pad (not shown) for signals from outside the head substrate. The selection circuit 502 is constructed in the same way as the circuit that selectively drives the plurality of heater elements 430.

In blowing the fuse elements 410, a switch 503 on the printing apparatus side is turned on to apply a blow voltage of a power supply 504 (e.g., drive voltage 24V for the heater elements 430) from the wire 506 to the ID pad 421 (although a single ID pad is shown, there are a plurality of them according to a layout). By selectively driving the drive elements 501, the corresponding fuse elements 410 are blown. On the other hand, in reading stored information representing whether the fuse elements 410 are blown or not, a read voltage (e.g., supply voltage 3.3 V of the logic circuit) is applied to a power supply pad (not shown) for fuse reading. The power supply pad is commonly connected to the plurality of fuse elements 410. Then, the drive elements 501 are selectively driven to read the stored information of the corresponding fuse elements 410, i.e., information representing whether or not the corresponding fuse elements are blown.

By setting a distinctive voltage difference between the blow voltage and the read voltage, stored information can be read without limiting the reading time or causing damage to the fuse elements 410. During the process of reading the stored information, if a drive element 501 corresponding to a blown fuse element 410 is driven, an output signal of the ID pad 421 goes high (H). When a drive element 501 corresponding to a fuse element not blown is driven, the output signal of the ID pad 421 goes low (L) That is, a read resistor not shown (its resistance is apparently larger than that of the fuse element 410) connected to the power supply pad for fuse reading (not shown) causes the output signal of the ID pad 421 to go low (L).

In this embodiment, a resistor element 500 is inserted in the circuit 506 of the printing apparatus that is used to apply the blow voltage for the fuse element 410 to the ID pad 421 of the substrate in the ink jet printing head. For example, the resistor element 500 may have a resistance of 40-120 ohm. The fuse element 410 including the central tapered portion has a resistance of 200-410 ohm, and the circuit excluding the fuse element 410 and including the resistor element 500 has a resistance of 170-330 ohm. In this example, the drive voltage for the heater element 430, 24 V, is used to blow the fuse element 410.

Figure 6A:
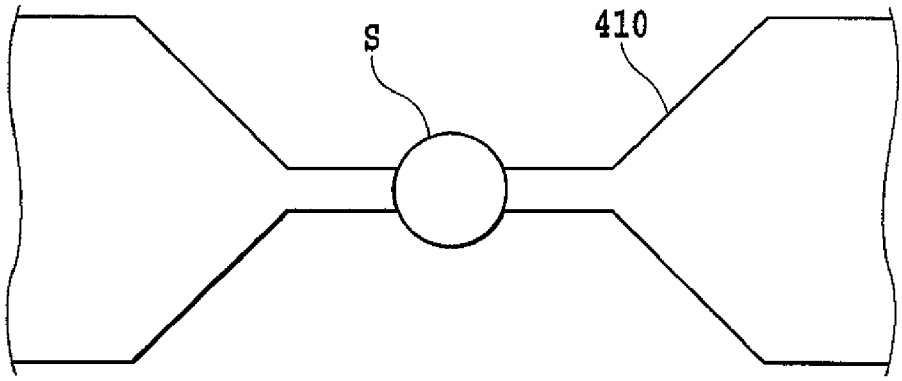
FIG. 6A illustrates a state of a fuse element blown by the fuse element blowing circuit of FIG. 5
Figure 6B:
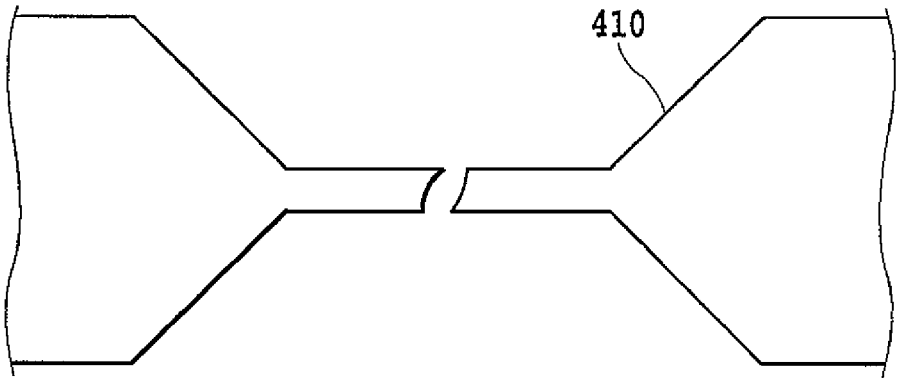
FIG. 6B illustrates an essential part of another blown fuse element for comparison.

If the resistor element 500 is not inserted in the circuit 506, the fuse element 410 may be blown as shown in FIG. 6B. This state of the blown fuse element results when the film surrounding the blown fuse element 410 does not melt and polysilicon, the material of the fuse element 410, fails to scatter sufficiently. If the fuse element 410 should be blown in this way, there is a possibility of an electrically open fuse element may be closed again by the melted polysilicon that exists in a narrow space.

If the resistor element 500 is inserted in the circuit 506 as in the case of this embodiment, the blown fuse element 410 stabilizes in a state shown in FIG. 6A. This state occurs when the film surrounding the blown fuse element 410 has melted to form a large enough space S in which to allow polysilicon, the material of the fuse element 410, to be fully scattered. If the fuse element 410 is blown in this manner, polysilicon scatters in a sufficiently large space S and becomes thin in density, with the result that the electrically open state can be kept continuously.

Figure 7A:
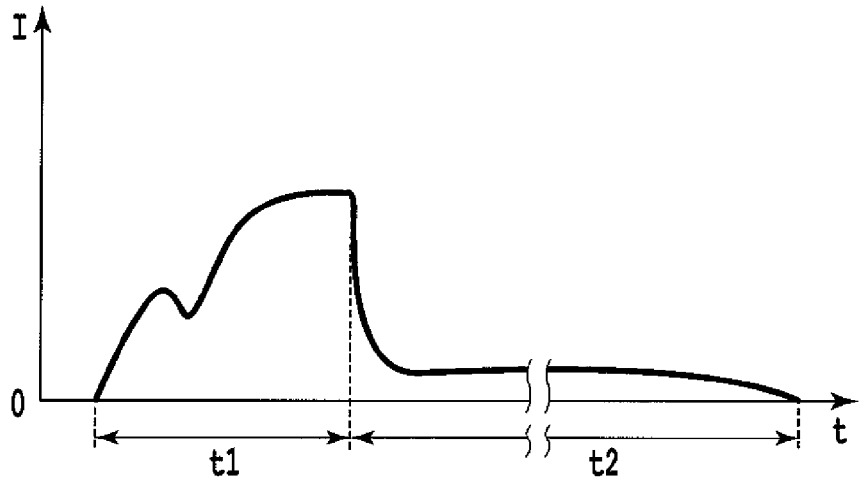
FIG. 7A is a waveform of a blowing current in the fuse element blowing circuit of FIG. 5
Figure 7B:
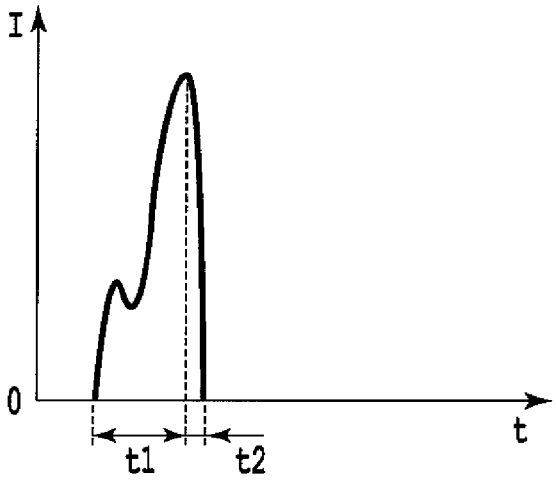
FIG. 7B is a waveform of another blowing current for comparison.

FIG. 7B shows a waveform of a blow current that passes through the fuse element 410 when it is blown as shown in FIG. 6B. It is seen that once the blow current I reaches its peak, it stops flowing soon. Therefore, a period T2 from a time point when the blow current I reaches its peak to a time point when it stops flowing is shorter than a period T1 from a time point when the blow current I rises to a time point when it reaches its peak.

FIG. 7A shows a waveform of a blow current that passes through the fuse element 410 when it is blown as shown in FIG. 6A. In this case, the blow current of less than 30 mA continues to flow for a few microseconds even after the blow current has reached its peak (maximum current) of 80 mA or higher. That is, a period T2 from a time point when the blow current I reaches its peak to a time point when it stops flowing is longer than a period T1 from a time point when the blow current I rises to a time point when it reaches its peak. The duration T2 of this continuous current flow is related to a leading edge of the blow current I. The more moderately the blow current rises, the longer the duration of continuous current flow tends to be. However, when the leading edge of the blow current I becomes too moderate, the organic resin layer 407 over the entire fuse element 410 may melt, impairing the reliability of the ink paths formed of the organic resin layer 407. The leading edge of the blow current I can be set to describe an optimal curve by the resistor element 500. It is noted that a temporary fall in the blow current I following the leading edge is due to characteristics of polysilicon.

If the leading edge of the blow current I is moderate, the temperature rise of the fuse element 410 is also moderate, allowing a wide area of polysilicon to be melted. As the area of polysilicon in a melted state increases, the current flows for a while in polysilicon even in the melted state. In the waveform of the blow current I in FIG. 7A, the current peaks when polysilicon begins to melt. The current that follows the peak flows through polysilicon in the melted state. In this state, the fuse element 410 continues to be heated and the overlying protective films on the fuse element is melted by the heat of the fuse element.

Figure 4B:
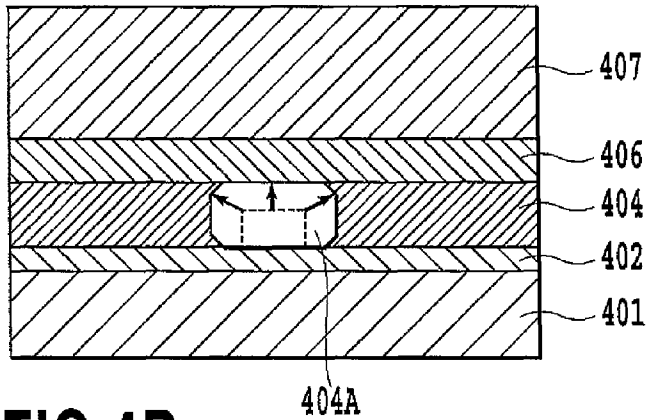
FIGS. 4A, 4B, 4C and 4D are cross-sectional views showing how the fuse element of FIG. 2 is blown.
Figure 4D:
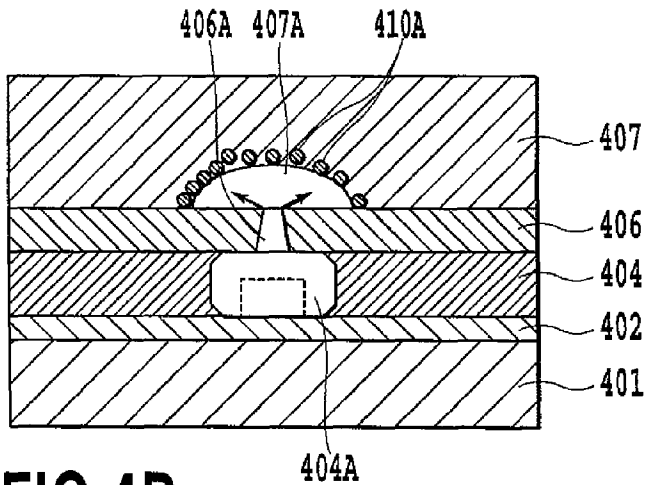
Figure 4A:
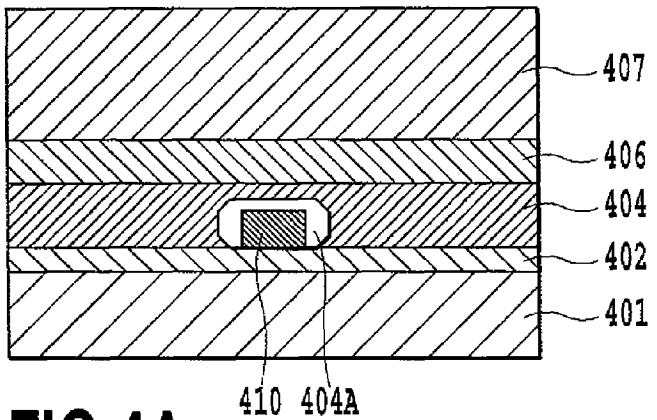
Figure 4C:
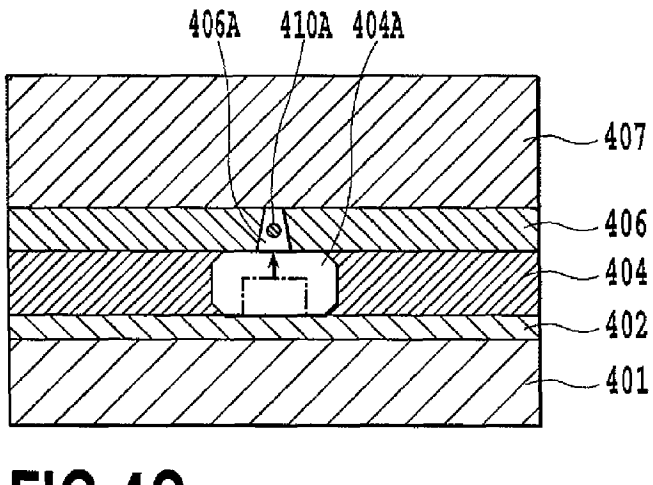

The plasma CVD-SiO layer 404 containing phosphorus, which has a far lower melting point than polysilicon and is easily gasified, is first melted and gasified to form a hollow space 404A as shown in FIG. 4A. The hollow space 404A inflates and is stopped when it reaches the plasma CVD-SiO layer 406 not containing phosphorus, as shown in FIG. 4B. Then, heat and pressure pierces a through-hole 406A in a part of the plasma CVD-SiO layer 406 not containing phosphorus, allowing melted polysilicon 410A to flow out of the through-hole 406A, as shown in FIG. 4C. The melted polysilicon 410A that has flowed out through the through-hole 406A melts and carbonizes a part of the organic resin layer 407, losing its thermal energy and cooling down to solidify.

As described above, since this embodiment has the resistor element 500 inserted in the blow current application circuit and sets the leading edge of the blow current to a moderate rate of rise, the blow current can be made to flow even after its peak is reached, continuing the heating of the fuse element 410. As a result, the fuse element 410 can be reliably blown as shown in FIG. 6A, realizing a safe blown state in which an open fuse element will not be closed again. Further, the melted polysilicon 410A can be accommodated in a space a predetermined distance deep from the blown portion of the fuse element 410, e.g., about 2 μm into the organic resin layer 407 side. Therefore, it is possible to realize a reliable blowing of the fuse element 410 and secure reliability of the portion where the fuse element 410 is formed.

Since the waveform of the blow current in practice changes depending on the resistance of electric circuits and influences of parasitic capacitances, the resistance of the resistor element 500 needs to be set to an optimum value. The waveform of the blow current may also vary depending on characteristics of individual electric circuits in a substrate on the printing apparatus side. The resistor element 500 provided on the printing apparatus side, as shown in FIG. 5, can be set to an optimal resistance by considering an entire system including the power supply and printed circuit board on the printing apparatus side.

Further, in this embodiment since the blow current application circuit is provided in the printing apparatus, it is possible, in a printing apparatus equipped with the printing head, to store various data at an appropriate timing by blowing the fuse elements 410. Of cause, it is also possible to store various data at time of shipping of the printing head by blowing the fuse elements 410.

Other Embodiments

The resistor element 500 may be provided in the printing head 400 or in the base 401. What is required is to install the resistor element 500 in a circuit portion that applies the blow current to the fuse elements 410, either on the printing apparatus side or on the printing head 400 side. The resistor element 500 may be constructed of wires having a particular resistance.

Figure 11:
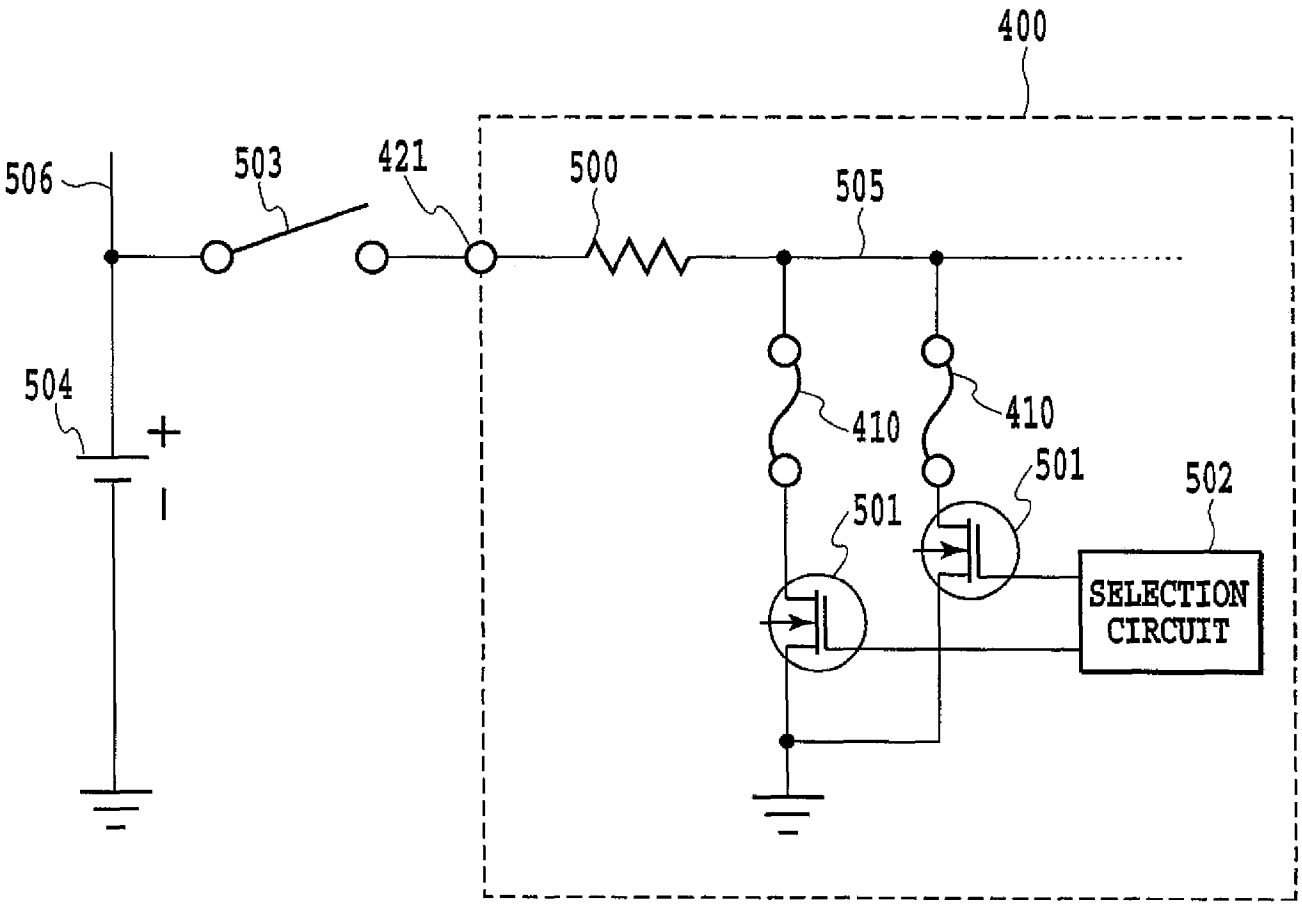
FIG. 11 is an explanatory view showing a fuse element blowing circuit in another embodiment of this invention.

FIG. 11 shows a circuit configuration when the resistor element 500 is provided on the printing head 400 side. The blow current waveform is set according to the characteristics of the fuse element 410 and drive element 501. In that case, the existing circuit on the printing apparatus side may be used and the effects that circuits in the printing head 400 have on the circuits in the printing apparatus are considered in advance. This enables the resistance of the resistor element 500 to be set optimally according to the electric circuits and various devices formed on the base 401 of the printing head 400. The resistor element 500 may be provided in the base 401. Further, the resistor element 500 may be provided commonly for a plurality of fuse elements 410 as shown in FIG. 11, or a plurality of resistor elements 500 may be provided one for each of the plurality of fuse elements 410.

If different printing heads are mounted on the same printing apparatus, or a plurality of printing heads are mounted simultaneously, a resistor element 500 having an appropriate resistance for individual printing heads is preferably used. In that case, it is possible to provide in the base 401 of the printing head 400 a resistor element 500 of an optimal resistance for each printing head 400. In manufacturing the base 401 using the semiconductor process, the resistor element 500 may be built into the base 401 at the same time to obviate the need for an additional step to form the resistor element 500. Particularly, by forming the resistor element 500 using a heater element 403 fabrication process, the printing head 400 equipped with the resistor element 500 can be manufactured without incurring additional cost.

Figure 12:
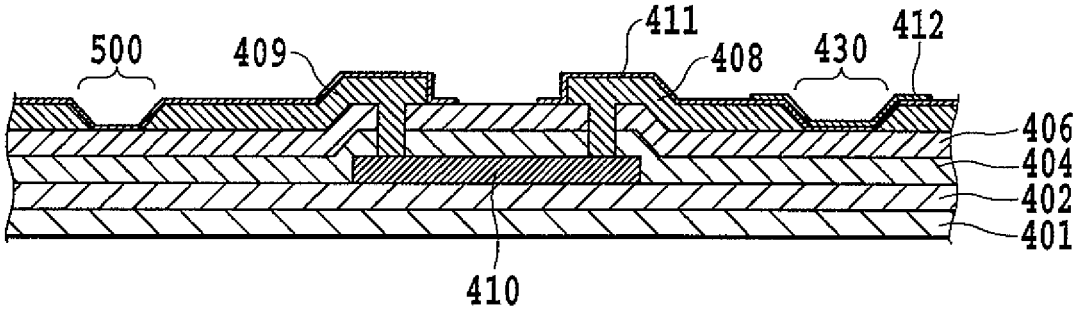
FIG. 12 is a cross-sectional view of a substrate of a printing head in the second embodiment of this invention.

FIG. 12 is a cross-sectional view showing an example construction of the base 401 into which the resistor element 500 is built. FIGS. 13A to 13H show a manufacturing process for a head substrate including the base 401.

Figure 13A:
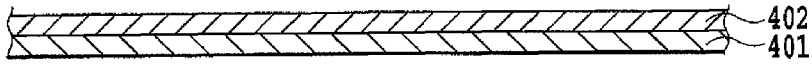
FIGS. 13A through 13H are cross-sectional views showing a process of manufacturing the printed circuit board of FIG. 12.
Figure 13B:
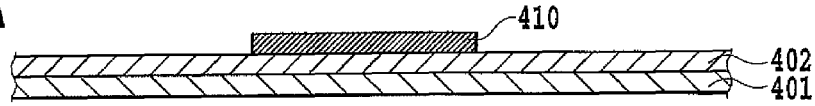
Figure 13C:
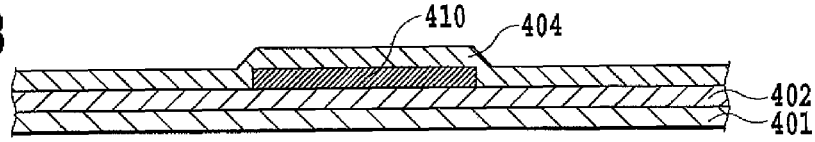
Figure 13D:
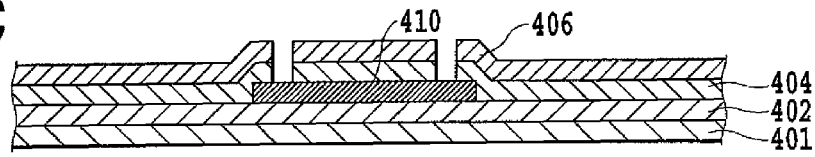
Figure 13E:
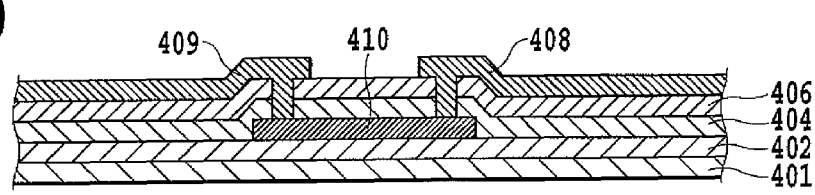

First, a thermal oxide film 402 is formed on the surface of the base 401 as shown in FIG. 13A, after which polysilicon is formed and patterned to form a fuse element 410, as shown in FIG. 13B. Then, as shown in FIG. 13C, a SiO film 404 containing phosphorus is formed as an interlayer insulating film. Then, as shown in FIG. 13D, a SiO film 406 not containing phosphorus is formed and a through-hole is formed in it. Then, as shown in FIG. 13E, a heater layer 408 to form the heater element 430 and a wire layer (Al) 409 to form the resistor element 500 are formed successively and patterned by dry etching.

Figure 13F:
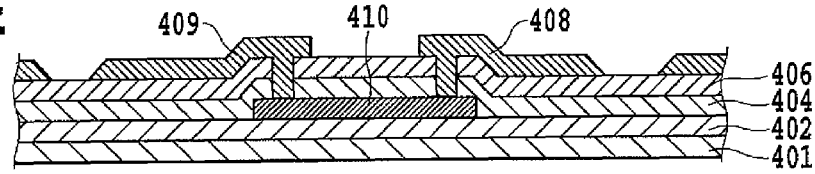
Figure 13G:
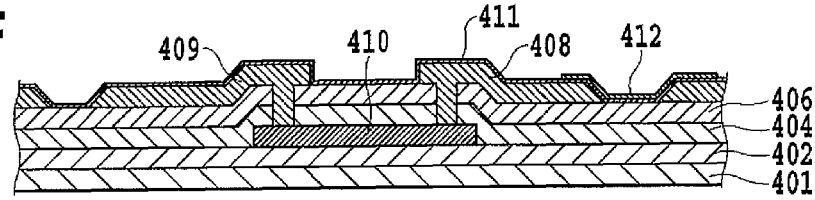
Figure 13H:
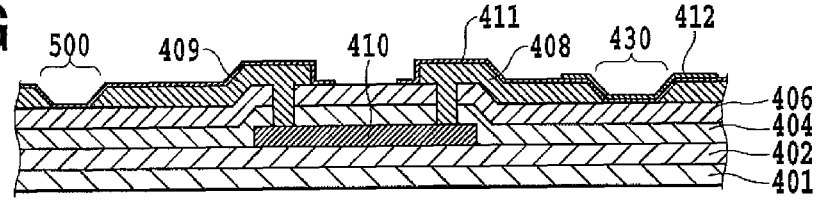

Then, as shown in FIG. 13F, the heater layer 408 and the wire layer 409 are wet-etched to form the heater element 430 and the resistor element 500. Then, as shown in FIG. 13G, a SiN film 411 as a protective film is formed, after which a Ta film 412 as a cavitation resistance film is formed and patterned. After this, as shown in FIG. 13H, a portion of the SiN film 411 over the fuse element 410 is removed and then an organic resin layer 407 (see FIG. 3) is deposited to form ink paths.

Further, the circuit for applying the blow current to the fuse element 410 may be provided in a fuse blow device separate from the printing apparatus. In that case, a variety of data can be stored by connecting the printing head 400 to the fuse blow device and blowing the fuse elements 410. The resistor element 500 may be provided either in the fuse blow device or in the printing head. The selection circuit 502 to select fuse elements to which the blow current is to be applied may be provided on the printing apparatus side. The printing apparatus may be provided with a circuit for reading data that corresponds to whether or not the individual fuse elements 410 have been blown, with a part of that circuit provided on the printing head side.

Further, this invention only requires that the fuse element blow current be able to be adjusted so as to continue to flow for a predetermined duration after a maximum current has flowed during the process of blowing fuse elements. The current adjusting means may include adjusting a resistance of a circuit of the fuse element through which the blow current flows or adjusting a voltage to be applied to that circuit.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2005-200160 filed Jul. 8, 2005, which is hereby incorporated by reference herein.

What is claimed is:

1. A method of blowing a fuse element capable of being blown by passing an electric current therethrough, the fuse element being provided on a substrate for an ink jet printing head, the substrate having ejection energy generation means for generating ejection energy, a first layer made of a material with a lower melting point than that of the fuse element and formed over the fuse element, and a second layer made of a material with a higher melting point than that of the first layer and formed over the first layer, the method comprising the steps of:

melting a part of the fuse element and gasifying a part of the first layer to form a hollow space by applying an electric current reaching a peak after rising with a moderate curve of a leading edge; and forming a hollow space in the second layer by continuing to apply the electric current to the fuse element after the fuse element has been melted.

2. The method of blowing the fuse element according to claim 1, wherein the electric current having the moderate curve of the leading edge is adjusted by a resistor element.

3. The method of blowing the fuse element according to claim 2, wherein the resistor element has a resistance of 40 ohm or higher to 120 ohm or lower.

4. The method of blowing the fuse element according to claim 2, wherein the fuse element has a resistance of 200 ohm or higher to 410 ohm or lower, and a circuit excluding the fuse element and including the resistor element has a resistance of 170 ohm or higher to 330 ohm or lower.

5. The method of blowing the fuse element according to claim 1, wherein the first layer is formed by a plasma CVD method using a SiO material containing phosphorus, and the second layer is formed by a plasma CVD method using a SiO material not containing phosphorus.

6. The method of blowing the fuse element according to claim 5, wherein the first layer has a thickness of 0.5 μm or more to 1 μm or less, and the second layer has a thickness of 0.3 μm or more to 0.8 μm or less.

7. A substrate for an ink jet printing head, comprising:

a fuse element;

ejection energy generation means for generating ejection energy;

a first layer made of a material with a lower melting point than that of the fuse element and formed over the fuse element; and a second layer made of a material with a higher melting point than that of the first layer and formed over the first layer, wherein a part of the fuse element is melted by applying an electric current reaching a peak after rising with a moderate curve of a leading edge and, by continuing to apply the electric current to the fuse element for a predetermined duration after the fuse element has been melted, a hollow space is formed in the first and second layers.

8. An ink jet printing head including the substrate for the ink jet printing head of claim 7, the ink jet printing head ejecting ink by driving the ejection energy generation means and being able to store data according to whether or not the fuse element has been blown.

9. An ink jet printing apparatus for printing an image on a printing medium by using an ink jet printing head capable of ejecting ink, the ink jet printing apparatus comprising:

a mounting portion on which the ink jet printing head of claim 8 can be mounted; and means for reading data stored in the fuse element in the ink jet printing head.

* * * * *